US005207503A

United States Patent [19]

McLaughlin

[11] Patent Number: 5,207,503

[45] Date of Patent: May 4, 1993

[54] XENON FESTOON STYLE LAMP

[75] Inventor: Donald D. McLaughlin, Austin, Tex.

[73] Assignee: Lucifer Lighting Company, San Antonio, Tex.

[21] Appl. No.: 831,416

[22] Filed: Feb. 5, 1992

[51] Int. Cl.[5] ..... F21S 3/00

[52] U.S. Cl. ..... 362/219; 362/226; 313/1; 313/578; 313/643

[58] Field of Search ..... 362/217, 219, 226, 240, 362/263; 313/1, 315, 578, 634, 643

[56] References Cited

U.S. PATENT DOCUMENTS

| | | | |
|---|---|---|---|
| 2,891,189 | 6/1959 | Bud et al. | 313/643 X |
| 3,448,320 | 6/1969 | Millikan | 313/578 X |
| 4,874,320 | 10/1989 | Freed et al. | 439/115 |
| 5,041,953 | 8/1991 | Dannatt | 362/226 X |

FOREIGN PATENT DOCUMENTS

| | | |
|---|---|---|
| 39-18566 | 7/1964 | Japan . |
| 60-95850 | 5/1985 | Japan . |

OTHER PUBLICATIONS

Pp. 4–7 of the journal Illumination Engineering Institute (Japan), vol. 67, No. 11 (1983).

*Primary Examiner*—Stephen F. Husar
*Attorney, Agent, or Firm*—Gunn, Lee & Miller

[57] ABSTRACT

A festoon style lamp containing xenon gas. The xenon lamp (22) has cylindrical, conical tipped end caps (36*a*) and (36*b*), a tungsten filament (34), and a cylindrical bulb (32). The end caps (36*a*) and (36*b*) are made of conductive material such as aluminum or nickel-plated brass, and are designed to adapt the lamp to fit into spade shaped contacts.

3 Claims, 2 Drawing Sheets

XENON FESTOON STYLE LAMP

FIELD OF THE INVENTION

Incandescent, festoon style lamps, more particularly festoon style lamps containing xenon gas.

BACKGROUND

There are three basic types of light sources used today—incandescent, fluorescent and high-intensity discharge lamps. Incandescent lamps produce light by electrically heating high resistant tungsten filaments to intense brightness. Fluorescent lamps produce light by establishing an arc between two electrodes in an atmosphere of very low pressure mercury vapor in a chamber (the glass tube). High-intensity discharge type lamps produce light by establishing an arc between two electrodes but with the electrodes only a few inches apart—in opposite ends of a small, sealed, translucent or transparent arc tube.

Incandescent general lighting lamps produce from 17 to 23 lumens of light per watt of power consumed dependent upon wattage, life and physical design features. The bulk of the radiant energy from incandescent light lies in visible and infrared region of the spectrum. Incandescent lamps follow established physical laws of thermal emission; energy is distributed in a smooth curve beginning at or near the UV range with very little deep blue radiation, increasing with wave length into the deep red.

Incandescent lamps use tungsten filaments, usually comprised of coiled tungsten wire heated to incandescence by an electrical current when the lamp is operating. Coiling the coiled filament increases its light producing efficiency. Filling inert gas (as compared to normal atmospheric gases) in the lamp envelope reduces tungsten evaporation and allows higher operation temperature of the filament.

Gases of helium, neon, argon, krypton, radon, and xenon are elements which constitute a group of inert gases, or noble gases, because of their extreme reluctance to form chemical compounds. Neon and argon are used in lighting tubes such as arc discharge tubes. The chief use of neon is in the arc discharge tubes, and the chief use of argon is to fill ordinary domestic light bulbs which usually contain a mixture of about 93% argon and 7% nitrogen.

Xenon is an element (symbol Xe) member of the noble gas group and has an atomic number of 54 and atomic weight of 131.30. It is colorless and has a boiling point of −108° C. (one atmosphere), is noncombustible, nontoxic and nonreactive. Its chief use is in photographic flash lamps, luminescent tubes and lasers, and also as an anesthetic. Xenon is commonly used to fill high-intensity arc lamps and in discharge tubes capable of producing high-intensity flashes of a very short duration. Such tubes are employed in electronic flash apparatus used in photography. Unlike helium, neon, and argon, xenon does form a few chemical compounds, for example, xenon tetrafluoride ($XeF_4$) and xenon oxide ($XeO_3$).

Halogens are a group of elements which, in a gaseous phase, are used to fill lamp bulbs, iodine being the most common. A halogen lamp produces greater luminosity than a nitrogen argon filament lamp. The quartz-halogen bulb, widely used for car headlights and projector bulbs, is a tungsten filament lamp operating at very high temperatures in iodine vapor. As the lamp burns, the gas combines with tungsten atoms that boil off the filament, and as it circulates inside the bulb, deposits the tungsten back onto the filament rather than on the bulb wall. This keeps the bulb wall clean and allows the lamp to deliver essentially its initial light output throughout life. Halogen bulbs have wall temperatures of at least 500° C. hotter than standard bulbs. These, of course, require the use of quartz rather than glass, dictated by the high temperature requirements.

A festoon style lamp is one that is suspended between two points, typically the end points of an elongated, cylindrical glass tube filled with a gas and having a filament, typically tungsten, coincident with the longitudinal axis of the cylindrical bulb. The lamp is held in place by conductive spades dimensioned to receive the two end cap/conductors of the lamp and to energize the same. The base of the lamp connects the lamp to the electric circuit and also provides an easy method of mounting the lamp and replacing it. The base or end caps are made of aluminum or nickel-plated brass. The bases are insulated from each other by the glass tube.

A typical incandescent tungsten filament festoon style lamp with a glass bulb (such as those identified as "Low Voltage Lamps" in the Lucifer Lighting Technical Information Guide, page 2) operates at a line voltage of 12 or 24 volts and will produce a color temperature of about 2,450° Kelvin, lumen output of 10 (3 watts), 37 (5 watts), or 75 (10 watts) with a lamp life (rated) of about 1,450 hours. This lamp has a tungsten filament and is filled with a mixture of 93% argon and 7% nitrogen. The same lamp filled with xenon gas will produce a color temperature of 2,620° K. at a lower lumen output, but will increase the lamp life (computed) to over 20,000 hours (5 watt/12 volt) or over 25,000 hours (5 watt/24 volt). For comparison purposes, the halogen lamps of approximately the same size will produce a color temperature of 3,000° K. and are rated at 1,000 hours (24 volt) and 2,000 hours (12 volt).

The increase in xenon lamp life is obtained by operating the lamp at voltages below the design voltage (test voltage in Table I, infra); to wit, the 12 volt xenon lamp being operated below its 13.5 design voltage and the 24 volt xenon lamp being operated below its 28 volt design voltage. These computed lamp lives for the xenon lamp are based on an equation used to calculate the effect of a change from the design voltage on lamp life as published in the Illuminating Engineering Society Lighting Handbook Reference Volume 1984.

The importance of the xenon lamp is then primarily in the increased lamp life and secondarily, in the higher color temperature. Because festoon lamps are used in series in strip lighting fixtures, often where there may be up to hundreds or thousands of bulbs, such as display cases for department stores, ceiling cove lighting in large commercial and residential applications, stair rail and stair step lighting, etc., where it becomes very important for maintenance purposes that lamp life periods be of as long duration as possible. Here, the radical increase in lamp life decreases by many times the lamp maintenance, and attendant cost to service and replace lamps. This is especially important when, as here, one has a multitude of lamps to a single lighting fixture. With lamp lives of greater than 20,000 hours, the xenon lamps need only be replaced at intervals of two to five years.

The lamp of the present invention is used to form strip lighting as opposed to lamps which produce light from a point source. Thus, the lamp of the present invention is designed to be used with, for example, the Lucifer Lighting Series 2000 strip lighting system.

Heretofore, no festoon style lamp has been available that contains xenon gas. The benefits of using xenon according to the teachings of the present specification is that it will result in higher color temperature (up to 2,620° K.) than traditional incandescent lamps, with extended lamp life up to four or five times beyond that of the presently available lamps, while operating at warmer temperatures than halogen lamps.

SUMMARY OF THE INVENTION

The object of the present invention is to provide a festoon style lamp containing xenon gas. The lamp has cylindrical, conically-tipped end caps, a tungsten filament, and a cylindrical glass bulb. The end caps are made of conductive material such as aluminum or nickel-plated brass, and are designed to adapt the lamp to fit into spade shaped contacts.

DETAILED DESCRIPTION OF THE PREFERRED EMBODIMENT

Figure 1:
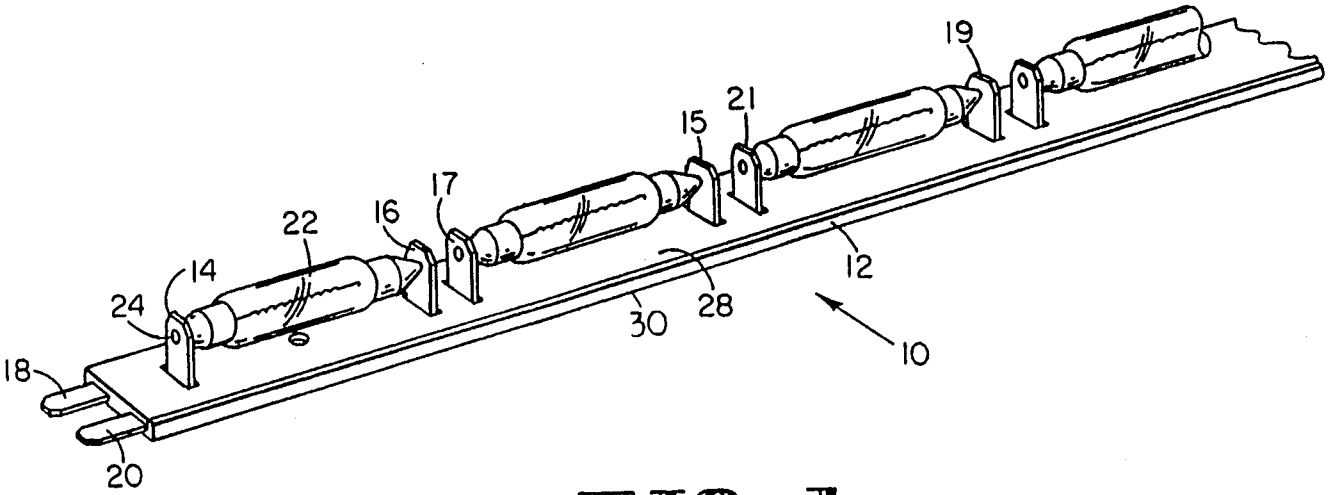
FIG. 1 is a perspective view showing the festoon style, xenon-filled lamps of the present invention inserted into a strip lighting fixture.

With reference now to the figures and in particular with reference to FIG. 1, there is depicted a light rail (10) representing the environment of the present invention. Light rail (10) is generally comprised of a track (12), successive pairs of contact tabs (14) and (16), and male plugs (18) and (20). Interposed between contact tabs (14) and (16) is a xenon-filled tube, the festoon style lamp of the present invention (22). Light rail (10) is designed to be used with incandescent lamps, such as the xenon festoon lamp (22) of the present invention.

A hole (24) is cut into tab (14) to receive one end of lamp (22). This secures lamp (22) in place. Upper track (28) and lower track (30) are essentially identical and made of nonconductive medium such as plastic or otherwise appropriately pliant material. Such material should be electrically insulative and preferably able to withstand high temperatures adjacent to incandescent xenon lamp (22). Appropriate plastics are polyethersulphone (PES), a high temperature thermoplastic that can be obtained from Imperial Chemical Industries of Wilmington, Del., under the brand name VICTREX TM.

Details of lighting strip (10) may be found in U.S. Pat. No. 4,874,320 issued Oct. 17, 1989, and assigned to assignee of the present invention, the specification and drawings of which are incorporated herein by reference.

Figure 2:
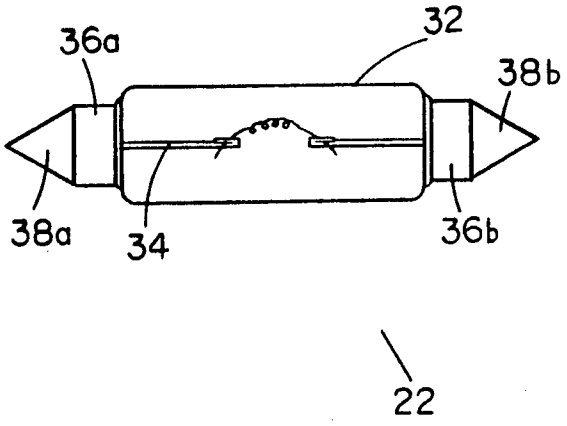
FIG. 2 is an elevational view of the xenon lamp of the present invention.

FIG. 2 illustrates the xenon lamp (22) of the present invention. Xenon lamp (22) is comprised of bulb (32), filament (34), and end caps (36*a*) and (36*b*).

Bulb (32) is made of tubular glass and is cylindrical in shape. Tube (32) has a wall thickness in the range of 0.51 millimeter (mm.), and diameter in the range of 10 mm., plus or minus 0.5 mm.

Filament (34) is tungsten of length in the range of 7 mm. to 9 mm., and is about 23 mm. in diameter. Straight sections of tungsten lead from both ends of coil center section to end caps (36*a*) and (36*b*) where they are joined in an electrical conductive relation such as with solder.

End caps (36*a*) and (36*b*) are preferably constructed of aluminum and formed into a cylindrical shape truncated with cones (38*a*) and (38*b*). The apex of the cones (38*a*) and (38*b*) are receivable within the holes (24) of spade connectors (14) and (16) (See FIG. 1).

Bulb (32) may either be frosted or clear. Bulb (32) joins filament (34) in gas sealed relation. During the manufacturing of lamp (22) air is evacuated from bulb (32) and filling gas of xenon replaces the emptying gas.

Filling lamp (22) of the present invention with xenon gas rather than the normal mix of 93% argon/7% nitrogen at a pressure of 1 atmosphere results in a lamp color temperature of approximately 2620° K., plus or minus 50° K., at 24 volts. Color shift should not occur before half of the rated life which is increased by using the unique combination set forth in the present specifications.

Additional Lamp characteristics are set forth in Table 1 below, and Table 2 indicates some of the dimensions of the lamp.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described in connection with the preferred embodiment, it is not intended to limit the invention to a particular form set forth, but on the contrary, it is intended to cover such alternatives, modifications, and equivalents as may be included within the spirit and the scope of the invention as defined by the appended claims.

TABLE I

| | LAMP CHARACTERISTICS | | | | | |
|---|---|---|---|---|---|---|
| | INITIAL CHARACTERISTICS | | | | | |
| RATING | TEST VOLTAGE (V) | LUMINOUS FLUX (lm) | WATTAGE (W) | LIFE RATED LIFE (h) | GLASS BULB | FILLING GAS |
| A12V5WX | 13.5 | 50 ± 20% | 5 ± 10% | 5,000 | CLEAR | XENON |
| A12V5WFX | | | | | FROSTED | |
| A12V10WX | | 125 ± 20% | 10 ± 10% | 3,000 | CLEAR | |
| A12V10WFX | | | | | FROSTED | |
| A24V5WX | 28.0 | 50 ± 20% | 5 ± 10% | 4,000 | CLEAR | |
| A24V5WFX | | | | | FROSTED | |
| A24V10WX | | 125 ± 20% | 10 ± 10% | 2,500 | CLEAR | |
| A24V10WFX | | | | | FROSTED | |

TABLE 2

| | OVERALL | LIGHT CENTER |
|---|---|---|

TABLE 2-continued

| BULB | BASE | LENGTH (mm) | LENGTH (mnx) | MOUNT TYPE |
|---|---|---|---|---|
| 10 ± 0.5 | SV8.5-9 | 44-2 | BULB CENTER | C-8 |

I claim:

1. An improved festoon style lamp having an elongated, cylindrical, tubular bulb, said bulb and having a filament extending therethrough, the removed ends of the filament being attached to a first end cap and a second end cap, the bulb in gas sealed relation with the filament and the end caps in electrical conductive association with the ends of the filament, the improvement comprising:

providing the bulb of the lamp with a filling gas made up of xenon.

2. An improved method for manufacturing a festoon style lamp having an elongated cylindrical bulb, an elongated filament with a first end and a second end, the ends of the filament in gas sealed relation with the ends of said bulb, the lamp having a first end cap and a second end cap, the end caps in electrical conductive association with the first end and the second end of the filament, the improved method comprising the steps of:

removing atmospheric gases from the bulb;

filling the bulb with xenon gas; and sealing the bulb ends in gas sealed relation to the ends of the filament.

3. A lamp for use in a light strip, the light strip having a multiple of paired spade connector tabs, the first tab of the pair being connected to a first conducting strip and the second tab of the pair being connected to a second conducting strip, the first and the second conducting strip being mounted in a nonconductive member, the tabs being tabular and having walls defining means to accept the lamp, the lamp comprising:

an elongated, cylindrical, tubular bulb, said bulb being filled with xenon gas, the bulb being made of glass and having a first end and a second end, the diameter of the bulb being in the range of 9.5 mm. to 10.5 mm., the length of the bulb being in the range of 42 mm. to 44 mm.;

an elongated filament of coiled tungsten having a first end and second end, the first end of said filament in gas sealed relation with the first end of said bulb and the second end of said filament in gas sealed relation with the second end of said bulb; and a first end cap and a second cap, the end caps being similarly dimensioned and cylindrical with conical truncations, the apex of the conical truncations being adapted to be received within the walls defining the acceptance means of the conductive tabs, said first end cap in electrical conductive association with the first end of said filament and said second end cap in electrical association with the second end of said second end cap.

* * * * *